US007377997B2

(12) United States Patent
Vinson et al.

(10) Patent No.: US 7,377,997 B2
(45) Date of Patent: May 27, 2008

(54) FIBROUS STRUCTURE COMPRISING A FIBER FLEXIBILIZING AGENT SYSTEM

(75) Inventors: Kenneth Douglas Vinson, Cincinnati, OH (US); Paul Joseph Coffaro, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 561 days.

(21) Appl. No.: 10/615,970

(22) Filed: Jul. 9, 2003

(65) Prior Publication Data

US 2005/0006043 A1 Jan. 13, 2005

(51) Int. Cl.

| | |
|---|---|
| ***D21H 23/24*** | (2006.01) |
| ***D21H 17/66*** | (2006.01) |
| ***D21H 17/68*** | (2006.01) |
| ***D21H 27/30*** | (2006.01) |
| ***D21H 17/63*** | (2006.01) |

(52) U.S. Cl. ..... 162/158; 162/123; 162/169; 162/181.1; 162/181.2; 162/181.4; 162/181.8; 162/135; 428/402; 424/402

(58) Field of Classification Search ..... 162/135, 162/158, 179, 181.1–181.8, 123–133, 125–1, 162/109, 169, 183–185; 428/537.5, 195.1, 428/402, 403; 424/402, 443
See application file for complete search history.

(56) References Cited

U.S. PATENT DOCUMENTS

| | | | | |
|---|---|---|---|---|
| 3,779,791 | A * | 12/1973 | Ploetz et al. | 422/1 |
| 4,289,808 | A | 9/1981 | Huang | |
| 4,376,674 | A | 3/1983 | Ali | |
| 4,766,015 | A | 8/1988 | Nikoloff et al. | |
| 5,240,562 | A * | 8/1993 | Phan et al. | 162/158 |
| 5,279,767 | A * | 1/1994 | Phan et al. | 516/59 |
| 5,302,249 | A * | 4/1994 | Malhotra et al. | 162/135 |
| 5,334,286 | A * | 8/1994 | Van Phan et al. | 162/158 |
| 5,622,599 | A * | 4/1997 | Sproule et al. | 162/186 |
| 5,624,532 | A * | 4/1997 | Trokhan et al. | 162/111 |
| 5,914,177 | A * | 6/1999 | Smith et al. | 428/195.1 |
| 5,935,384 | A | 8/1999 | Taniguchi | |
| 5,981,044 | A * | 11/1999 | Phan et al. | 428/212 |
| 6,133,166 | A * | 10/2000 | Nissing et al. | 442/61 |
| 6,162,329 | A | 12/2000 | Vinson et al. | |
| 6,270,878 | B1 * | 8/2001 | Wegele et al. | 428/195.1 |
| 6,306,408 | B1 | 10/2001 | Eichhorn et al. | |
| 6,310,268 | B1 | 10/2001 | Rangachari et al. | |
| 6,547,928 | B2 * | 4/2003 | Barnholtz et al. | 162/127 |
| 6,824,648 | B2 * | 11/2004 | Edwards et al. | 162/111 |
| 6,872,282 | B1 * | 3/2005 | Kohler et al. | 162/135 |
| 7,008,507 | B2 * | 3/2006 | Urlaub et al. | 162/134 |
| 2001/0055609 | A1 * | 12/2001 | Shantz et al. | 424/443 |
| 2002/0168518 | A1 | 11/2002 | Bond et al. | |
| 2002/0185239 | A1 * | 12/2002 | Kimpimaki et al. | 162/173 |

(Continued)

FOREIGN PATENT DOCUMENTS

| | | |
|---|---|---|
| EP | 0 617 164 B1 | 9/1994 |

(Continued)

*Primary Examiner*—José A Fortuna
(74) *Attorney, Agent, or Firm*—C. Brant Cook; Betty J. Zea; David M. Weirich

(57) ABSTRACT

Fibrous structures comprising a fiber flexibilizing agent system, methods for making such fibrous structures and sanitary tissue products comprising such fibrous structures are provided.

12 Claims, 8 Drawing Sheets

U.S. PATENT DOCUMENTS

| | | | | |
|---|---|---|---|---|
| 2002/0192407 | A1* | 12/2002 | Hendrix et al. | 428/34.3 |
| 2003/0056915 | A1* | 3/2003 | Hietanen et al. | 162/141 |
| 2003/0136531 | A1* | 7/2003 | Edwards et al. | 162/111 |
| 2004/0052834 | A1* | 3/2004 | West et al. | 424/443 |
| 2004/0118534 | A1* | 6/2004 | Anderson | 162/111 |
| 2005/0006043 | A1* | 1/2005 | Vinson et al. | 162/181.1 |
| 2006/0113049 | A1* | 6/2006 | Knobloch et al. | 162/117 |
| 2006/0275347 | A1* | 12/2006 | Evers Smith et al. | 424/443 |

FOREIGN PATENT DOCUMENTS

| | | | |
|---|---|---|---|
| EP | 0 622 432 | A1 | 11/1994 |
| EP | 0 677 612 | B1 | 10/1995 |
| EP | 0 829 576 | A2 | 3/1998 |
| EP | 0 688 901 | B1 | 10/1999 |
| EP | 1 176 254 | A1 | 1/2002 |
| EP | 1 225 276 | A1 | 7/2002 |
| JP | 5-156596 | | 6/1993 |
| JP | 7-216786 | | 8/1995 |
| JP | 11332777 | A * | 12/1999 |
| JP | 2001-262489 | | 9/2001 |

* cited by examiner

FIBROUS STRUCTURE COMPRISING A FIBER FLEXIBILIZING AGENT SYSTEM

RELATED APPLICATIONS

This application claims priority to prior copending U.S. application Ser. No. 10/302,228 filed Nov. 22, 2002.

TECHNICAL FIELD

This invention relates to fibrous structures, especially fibrous structures that are incorporated into sanitary tissue products. More particularly, the present invention relates to fibrous structures comprising a fiber flexibilizing agent system and methods for making such fibrous structures.

BACKGROUND OF THE INVENTION

Conventional sanitary tissue products incorporate fibrous structures that typically contain fiber flexibilizing agents, such as softening agents. Fiber flexibilizing agents reduce the opacity of fibrous structures within which they are incorporated.

Accordingly, there is a need for fibrous structures that contain a fiber flexibilizing agent system wherein the net change in opacity of the fibrous structure resulting from the fiber flexibilizing agent system is greater than the net change in opacity of the fibrous structure resulting from individual components of the fiber flexibilizing agent system.

SUMMARY OF THE INVENTION

The present invention fulfills the need described above by providing a fibrous structure comprising a fiber flexibilizing agent system.

In one aspect of the present invention, a fibrous structure comprising a fiber, preferably a cellulosic fiber, and a fiber flexibilizing agent system comprising a fiber flexibilizing agent wherein the net change in opacity of the fibrous structure resulting from the fiber flexibilizing agent system is greater than the net change in opacity of the fibrous structure resulting from individual components of the fiber flexibilizing agent system, is provided.

In still another aspect of the present invention, a method for making a fibrous structure comprising the steps of:

a) providing a fibrous structure;

b) contacting the fibrous structure with a fiber flexibilizing agent system comprising a fiber flexibilizing agent such that the net change in opacity of the fibrous structure resulting from the fiber flexibilizing agent system is greater than the net change in opacity of the fibrous structure resulting from individual components of the fiber flexibilizing agent system, is provided.

In even another aspect of the present invention, a fibrous structure made by a method in accordance with the present invention, is provided.

In yet another aspect of the present invention, a single-ply or multi-ply sanitary tissue product comprising a fibrous structure in accordance with the present invention is provided.

Accordingly, the present invention provides fibrous structures comprising a fiber flexibilizing agent system comprising a fiber flexibilizing agent; methods for making such fibrous structures; and sanitary tissue products comprising such fibrous structures.

DETAILED DESCRIPTION OF THE INVENTION

Definitions

Figure 1:
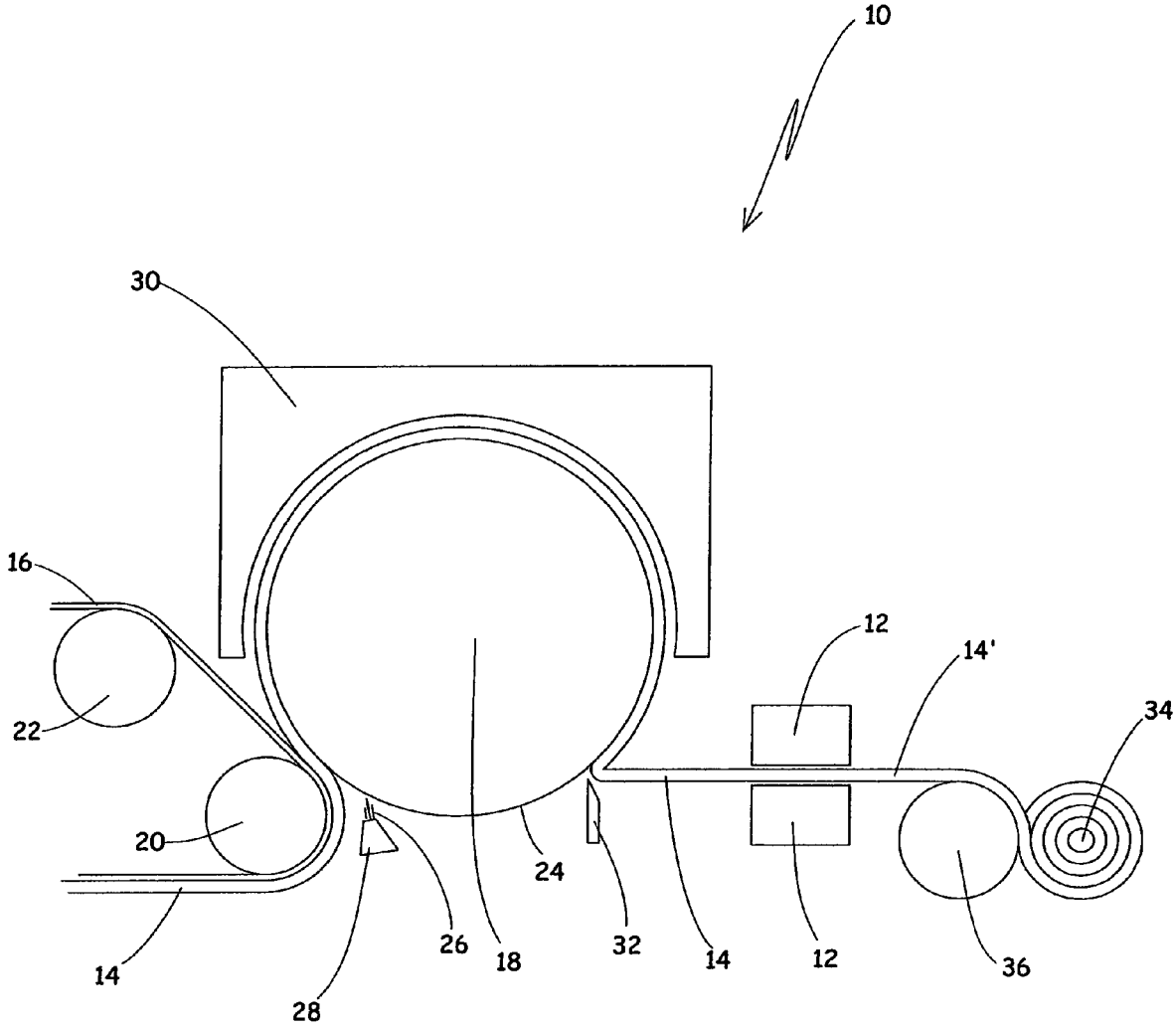
FIG. 1 is a schematic representation of a method in accordance with the present invention.

"Fiber" as used herein means an elongate particulate having an apparent length greatly exceeding its apparent width, i.e. a length to diameter ratio of at least about 10. More specifically, as used herein, "fiber" refers to papermaking fibers. The present invention contemplates the use of a variety of papermaking fibers, such as, for example, natural fibers or synthetic fibers, or any other suitable fibers, and any combination thereof. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking. In addition to the above, fibers and/or filaments made from polymers, specifically hydroxyl polymers may be used in the present invention. Nonlimiting examples of suitable hydroxyl polymers include polyvinyl alcohol, starch, starch derivatives, chitosan, chitosan derivatives, cellulose derivatives, gums, arabinans, galactans and mixtures thereof.

"Sanitary tissue product" as used herein means a soft, low density (i.e. <about 0.15 g/cm3) web useful as a wiping implement for post-urinary and post-bowel movement cleaning (toilet tissue), for otorhinolaryngolical discharges (facial tissue), and multi-functional absorbent and cleaning uses (absorbent towels).

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a paper product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$). The basis weight ($g/m^2$) is calculated by dividing the average weight (g) by the average area of the samples ($m^2$).

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Ply" or "Plies" as used herein means an individual fibrous structure optionally to be disposed in a substantially contiguous, face-to-face relationship with other plies, forming a multiple ply fibrous structure. It is also contemplated that a single fibrous structure can effectively form two "plies" or multiple "plies", for example, by being folded on itself.

"Neat fibrous structure" and/or "fibrous structure in neat form" as used herein means a fibrous structure consisting only of fibers.

"Opacity of neat fibrous structure" as used herein means the resulting opacity of the neat fibrous structure as determined according to the Opacity Test described below.

"Net change in opacity of the fibrous structure resulting from the fiber flexibilizing agent system" as used herein means the difference between the opacity of the fibrous structure comprising the fiber flexibilizing agent system and the opacity of the fibrous structure in its neat form.

"Net change in opacity of the fibrous structure resulting from individual components of the fiber flexibilizing agent system" as used herein means the sum of the difference between the opacity of the fibrous structures each comprising a single individual component of the fiber flexibilizing agent system and the opacity of the fibrous structure in its neat form.

As discussed herein, the net change in opacity of the fibrous structure resulting from the fiber flexibilizing agent system is greater than the net change in opacity of the fibrous structure resulting from individual components of the fiber flexibilizing agent system.

A nonlimiting example for clarity purposes is where the net change in opacity of the fibrous structure resulting from the fiber flexibilizing agent system is −0.3% points and the net change in opacity of the fibrous structure resulting from individual components of the fiber flexibilizing agent system is −0.5% points. Since the net change in opacity of the fibrous structure resulting from the fiber flexibilizing agent system is greater than the net change in opacity resulting from individual components of the fiber flexibilizing agent system, this fibrous structure would be within the scope of the present invention.

In another nonlimiting example, the net change in opacity of the fibrous structure resulting from the fiber flexibilizing agent system is +0.2% points and the net change in opacity of the fibrous structure resulting from individual components of the fiber flexibilizing agent system is −0.5% points. Since the net change in opacity of the fibrous structure resulting from the fiber flexibilizing agent system is greater than the net change in opacity resulting from individual components of the fiber flexibilizing agent system, this fibrous structure would be within the scope of the present invention.

In still another nonlimiting example, the net change in opacity of the fibrous structure resulting from the fiber flexibilizing agent system is +0.2% points and the net change in opacity of the fibrous structure resulting from individual components of the fiber flexibilizing agent system is +0.05% points. Since the net change in opacity of the fibrous structure resulting from the fiber flexibilizing agent system is greater than the net change in opacity resulting from individual components of the fiber flexibilizing agent system, this fibrous structure would be within the scope of the present invention.

Fibrous Structure

The fibrous structure (web) of the present invention may be incorporated into a single-ply or multi-ply sanitary tissue product.

The fibrous structure may be foreshortened, such as via creping, or non-forshortened, such as not creping.

The fibrous structures of the present invention are useful in paper, especially sanitary tissue paper products including, but not limited to: conventionally felt-pressed tissue paper; pattern densified tissue paper; and high-bulk, uncompacted tissue paper. The tissue paper may be of a homogenous or multilayered construction; and tissue paper products made therefrom may be of a single-ply or multi-ply construction. The tissue paper preferably has a basis weight of between about 10 $g/m^2$ and about 120 $g/m^2$, and density of about 0.60 g/cc or less. Preferably, the basis weight will be below about 35 $g/m^2$; and the density will be about 0.30 g/cc or less. Most preferably, the density will be between about 0.04 g/cc and about 0.20 g/cc as measured by the Basis Weight Method described herein.

The fibrous structure may be made with a fibrous furnish that produces a single layer embryonic fibrous web or a fibrous furnish that produces a multi-layer embryonic fibrous web.

The fibrous structures of the present invention and/or paper products comprising such fibrous structures may have a total dry tensile of greater than about 59 g/cm (150 g/in) and/or from about 78 g/cm (200 g/in) to about 394 g/cm (1000 g/in) and/or from about 98 g/cm (250 g/in) to about 335 g/cm (850 g/in) as measured by the Total Dry Tensile Method described herein.

The fibrous structures of the present invention and/or paper products comprising such fibrous structures may have a total wet tensile strength of greater than about 9 g/cm (25 g/in) and/or from about 11 g/cm (30 g/in) to about 78 g/cm (200 g/in) and/or from about 59 g/cm (150 g/in) to about 197 g/cm (500 g/in) as measured by the Total Wet Tensile Strength Method described herein. Wet strength can be provided by adding permanent wet strength or temporary wet strength resins as is well known in the art.

A nonlimiting suitable process for making a fibrous structure of the present invention comprises the steps of providing a furnish comprising plurality of cellulosic fibers and a wet strength agent; forming a fibrous structure from the furnish; heating the fibrous structure to a temperature of at least about 40° C. and a moisture content of less than about 5%; and contacting a surface of the fibrous structure with a fiber flexibilizing agent system.

It is beneficial if the fiber flexibilizing agent of the present invention is applied to an overdried fibrous structure shortly after the fibrous structure is separated from a drying means and before it is wound onto a parent roll. Alternatively or additionally, the composition can be incorporated into the fibrous structure before or during its assembly or to the dry fibrous structure having a somewhat higher moisture content, for example, a web in moisture equilibrium with its environment as the web is unwound from a parent roll as, for example, during an off-line converting operation.

Fiber Flexibilizing Agent System

The fibrous structure of the present invention comprises a fiber and a fiber flexibilizing agent system.

The fiber flexibilizing agent system comprises a fiber flexibilizing agent and optionally, an opacity increasing agent.

When present in the fiber flexibilizing agent system, the fiber flexibilizing agent and opacity increasing agent are present in the fiber flexibilizing agent system at a weight ratio of from about 1:100 to about 10000:1 and/or from about 2:1 to about 100:1.

Fiber Flexibilizing Agent

The fibrous structure of the present invention comprises a fiber flexibilizing agent system comprising a fiber flexibilizing agent.

The fiber flexibilizing agent comprises a humectant and/or a plasticizer.

In one embodiment, the fiber flexibilizing agent has a vapor pressure of less than about 2 mm at 70° F.

Preferably, the fiber flexibilizing agent has a weight average molecular weight of less than about 1000 g/mol and/or from about 50 g/mol to about 1000 g/mol and/or from about 100 g/mol to about 400 g/mol.

The term "humectant" as used herein means a material that raises the equilibrium moisture content in excess of that of the fibrous structure without a humectant. The humectant can be selected from the group consisting of hydroxyl-bearing organic compounds such as glycerol; pentaerythritol sugars such as starch hydrosolates an example of which is high fructose corn syrup; sugar alcohols such as sorbitol, maltitol, and mannitol; deliquescent salts such as calcium chloride and sodium lactate; triacetin; propylene glycol and mixtures thereof.

The term "plasticizer" as used herein refers to a material capable of being absorbed into the fiber and imparting a greater flexibility thereto. Any compound bearing hydrogen atoms bonded to an oxygen or a nitrogen is classified as a plasticizer for purposes of the present invention, provided the total mass of such hydrogen atoms comprise at least about 1% by weight of said plasticizer and said plasticizer has a vapor pressure less than about 2 mm Hg at 70° F. Nonlimiting examples of suitable plasticizers include urea and low-water-imbibing mono, di-, and oligo-saccharides including dextrose and sucrose; alkyloxylated glycols; ethylene carbonate; propylene carbonate; and any combinations thereof.

Also included as plasticizers are ethyloxylated and propyloxylated compounds having a vapor pressure less than about 2 mm Hg at 21° C. (70° F.). Polyethylene glycol and polypropylene glycol are nonlimiting examples of such plasticizers.

Other nonlimiting examples of plasticizers include anhydrides of sugar alcohols such as sorbitan; animal proteins such as gelatin; vegetable proteins such as soybean, cottonseed, and sunflower protein; alkyl glycols and alkoxylated glycol compounds including polyethylene glycol, polypropylene glycol and copolymers such as polyoxyethylene/polyoxypropylene having the following structure:

$$HO—(CH_2—CH_2—O)_x(CHCH_3—CH_2O)_y—(CH_2CH_2—O)_z—OH$$

wherein x has a value ranging from about 2 to about 40, y has a value ranging from about 10 to about 50, and z has a value ranging from about 2 to about 40, and more specifically x and z have the same value. These copolymers are available as Pluronic® from BASF Corp., Parsippany, N.J. In one embodiment, at least 0.1% and/or at least 2% and/or at least 5% and/or at least 10% and/or at least 15% to about 60% and/or to about 50% and/or to about 30% and/or to about 20% by weight of the fibrous structure of fiber flexibilizing agent is applied to the fibrous structure more specifically greater than about 5% and even more specifically greater than about 10%. The amount of fiber flexibilizing agent system should be less than about 60%, more specifically less than about 30% and even more specifically less than about 20%.

Opacity Increasing Agent

The fibrous structure may comprise an opacity increasing agent.

An opacity increasing agent ("opacifier") as used herein refers to any non-fibrous material added to the substrate to effect an increase in the opacity of the subject fibrous structure.

The neat fibrous structures have a certain opacity as a result of its fibrous constituents' ability to scatter and/or absorb light coming into contact with the neat fibrous structure.

Opacity increasing agents, when added to fibrous structures, increase the opacity of the fibrous structure by limiting light transmittance by either or both of two mechanisms: 1) light is reflected by scattering or 2) light is absorbed. Opacity increasing agents include those materials that increase the opacity of neat fibrous structures above the opacity of the neat fibrous structure as well as those materials that increase the opacity of an already reduced opacity fibrous structure even if the increased opacity resulting from the opacity increasing agent is not greater than the opacity of the neat fibrous structure.

1) Reflecting or scattering of light is accomplished when the light passes from a medium of one refractive index to another. A beam of light striking such an interface obliquely will experience a combination of bending (refraction) and reflection. The extent of reflection depends on the striking angle and the difference in refractive index of the two materials. Scattering effect will be maximized when the number of interfaces between refractive indicies is maximized and when the level of the difference in refractive index is maximized.

Opacity increasing agents which function by reflecting or scattering light are small particles and/or are particles having a high refractive index. While generally, smaller is preferred for increasing opacity, it is clear that excessively small particles lose their ability to opacify because they are smaller than the wavelength of the light that they are intended to scatter. Therefore, there is a practical optimum in particle size, which maximizes the reflection or scattering effect of a particulate. An ideal opacifier is finely divided titanium dioxide, having an average equivalent spherical diameter of about 0.2 micrometers. Since titanium dioxide is costly and has other negative side effects, other opacifiers are recommended. These include, but are not limited to, hydrated aluminum silicate (clay), calcium carbonate and starch powder. Most preferred for the present invention is starch powder. It is has a moderate density, is not abrasive, and is compatible with the most preferred fiber flexibilizing agent systems of the present invention. An acceptable grade of starch powder can be purchased from ACH Food Companies of Memphis, Tenn. under the trade name, Argo® Corn Starch.

2) Absorption of light is also effective in increasing opacity and chemicals which absorb light are included within the definition of opacifers as used herein. Preferably, a light absorbing opacifier will be used in combination with a reflective/scattering opacifier in order to prevent the substrate from appearing to have excessive color (selective absorption of the visible spectrum) or to appear excessively gray or black (broad absorption of the visible spectrum). It is also possible to counteract the absorption effect to some degree by including an optical brightener, because it is capable of increasing brightness without decreasing opacity.

Light absorbing properties are obtained by including a pigment having significant coloration. Suitable colored pigments can be purchased from Bayer AG headquartered in Leverkusen, Germany under the names HALOPONT™, LEVANYL® and PONOLITH™. Light absorbing properties can also be obtained by adding a dye. Suitable dyes can be obtained from Bayer AG under the tradenames LEVACELL®, LEVACELL® KS and PONTAMINE®. Level of inclusion of such pigments or dyes is goverened by the opacity level needed as well as acceptable levels of coloration imparted to the product. Inclusion rates as low as 0.001% can impart a visible color for example. If coloration is acceptable, rates in the range of 0.1% to 1% or higher can be used. Often it is desirable to use a combination of colors in order to generate a broad spectrum of absorption so that the result appears gray rather than a pure color. Many authorities believe that, at equivalent brightness, a blue tint is generally believed to appear more "white" than an equivalent brightness of yellow tint, so blue dyes or pigments might be preferred depending on the application. The depression in brightness which invariably accompanies the use of light absorbing molecules or particles can be partially or entirely counteracted by the use of fluorescent whitening agents (FWAs). Suitable FWAs can be purchased from Bayer under the tradename BLANKOPHOR®. Any of the before mentioned pigments, dyes, or FWAs can be added to the fibrous structure of the present invention by adding prior to forming the structure, i.e. so-called wet end addition in papermaking. They can also be added, for example, by spraying, printing, extrusion on the web during or after its formation. They also can be added to the fiber flexbilizing agent and applied concurrently. Wet end precipitation might require fixatives and/or retention aids as are well known to those skilled in the art.

Opacity is defined as the property of a paper to resist the transmission of both diffuse and nondiffuse light through it. It prevents show through of a user's fingers in contact with the backside of a fibrous structure. As used herein "opacified fibrous structure" refers to a fibrous structure made more opaque by addition of an opacifying agent, such as a particulate.

Opacifying agents are used in the present invention for the optical improvements they afford. In general, optical properties affected by the inclusion of opacifying agents are opacity, brightness, and color. The degree to which each of these properties is altered is very much dependent upon the type of opacifying agent, the nature of the fiber furnish, and the basis weight of the final sheet. Almost all particulates will, upon inclusion into a fibrous structure, result in increased opacity. As basis weight is increased, maintenance of a constant level of a particulate will result in a smaller increase in measured opacity, relative to an unmodified fibrous structure. At very low basis weight, a particulate's opacifying performance is maximized; at higher basis weight, it's minimized.

The opacifying efficiency an opacity increasing agent possesses is related to its ability to scatter or absorb light at a wavelength of 572 nm. The scattering power of a particulate is affected by several fundamental factors, namely, its refractive index relative to the surrounding medium, and the particle size (and/or shape) and the number of light scattering surfaces it makes available upon inclusion in the dried web. The higher the refractive index the particulate possesses, the greater the light scattering at the air/opacity increasing agent or fiber/opacity increasing agent interface. In a fibrous structure according to the present invention, it is one of these two interfaces which offer the highest potential source for light scattering resulting in increased opacity.

Opacity as used herein is defined by the following equation:

$$O=100-100\times(1-MO/100)^{(1/BW)}$$

wherein,

O=opacity in %,

MO=measured opacity in %

BW=basis weight in grams/meter$^2$

Opacity, so defined, is normalized to the equivalent opacity of 1 g/m$^2$ of basis weight of the fibrous structure. This makes comparisons of the opacifying power among different fibrous structures easier to accomplish by removing basis weight as a factor contributing to opacity.

Measured opacity is calculated as the ratio of the apparent reflectance of one sheet of paper with a black backing to the apparent reflectance of the sheet with a white backing. A sample whose reflectance is not changed by changing its backing from white to black will have an opacity of 100 and a sample whose reflectance changes from a high value to zero by changing the backing from white to black will have an opacity of zero.

Measured opacity is determined using a modified Hunter Color Meter. The modified Hunter Color Meter consists of a Hunter LabScan XE Sensor with DP9000 processor, model # LSXE/DP9000 with universal software, model # LSXE/UNI having the following options: sensor port-down stand with sample clamp assembly, part number HL#D02-1009-350, automated variable sample illumination (to obtain 25 mm (1 inch) viewing area), and automated UV control, with a ColorQUEST DP-9000 Spectrocolorimeter, Labscan Spectro Color Meter, or Hunter Color Difference Meter D25D2M or D25D2A all available from Hunter Associates Laboratories, Inc. of Reston, Va.

A Hunter Color Associates spring-loaded sample (HL#D02-1009-350) raising stage, rather than the lab jack supplied with the instrument, is used. In addition, standard plates of colors white and black are required. The plates will need to be cleaned between readings using a clean, soft, absorbent laboratory wipe.

Because the effects of humidity and temperature are negligible on opacity, the samples do not need to be conditioned. However, they should be kept free from corrosive vapors, dirt and excess lint. Also, creasing, wrinkling and tearing of the samples should be avoided. Before testing, set the instrument color scale to "XYZ", the Observer setting to "10°", and the Illuminant setting to D65. For pre-test instrument standardization, follow the procedures in the manufacturer's instrument manual. Place the selected opacity sample on the white uncalibrated plate. Raise the sample and plate into place under the sample port and determine the "Y" value. Lower the sample and plate. Without rotating the sample itself, remove the white plate and replace with the black tile. Again, raise the sample and tile and determine the "Y" value. For opacity, some colorimeter models have the capability to perform this operation automatically, check the manufacturer's operator's manual.

$$\%\ \text{Measured Opacity} = \frac{Y\ \text{reading of black plate}}{Y\ \text{reading of white tile}} \times 100$$

Report Measured Opacity to three significant figures and use the before-mentioned mathematical relationship using basis weight to determine the % Opacity.

Nonlimiting examples of opacity increasing agents may include pigments, particulates, fillers, dyes and fluorescent whitening agents (FWAs).

Nonlimiting examples of particulate and/or pigment-based opacity increasing agents suitable for use in the present invention include clay, calcium carbonate, titanium dioxide, talc, aluminum silicate, calcium silicate, alumina trihydrate, activated carbon, pearl starch, calcium sulfate, glass microspheres, diatomaceous earth, and mixtures thereof.

The fiber flexibilizing agent system can beneficially be applied to a hot tissue web. As used herein, the term "hot tissue web" refers to a tissue web that has an elevated temperature relative to room temperature. Specifically, the elevated temperature of the web is at least about 43° C., more specifically at least about 54° C., and even more specifically at least about 65° C. The hot web has a low equilibrium moisture content that facilitates adding the composition at the highest levels requiring minimal re-drying of the web and in some instances no re-drying at all. Applicants have found that the levels of up to about 30% of some fiber flexibilizing agent systems can be added to the hot tissue web at the dry end of the papermaking machine without the necessity for re-drying of the web.

The moisture content of a tissue web is related to the temperature of the web and the relative humidity of the surrounding environment. As used herein, the term "over-dried tissue web" refers to a tissue web that is dried to a moisture content less than its equilibrium moisture content at standard test conditions of 23° C. and 50% relative humidity. The equilibrium moisture content of a tissue web placed in the standard testing conditions is approximately 7%. A tissue web of the present invention can be overdried by raising the drying temperature of drying means known in the art, such as, for example, a Yankee dryer or through-air drying. An overdried tissue web can have a moisture content of less than about 7%, more specifically less than about 6%, and even more specifically less than about 3%.

Other, optional, materials can be added to the aqueous papermaking furnish, the embryonic web, or to the finished web to impart other desirable characteristics to the product or improve the papermaking process so long as they are compatible with the chemistry of the fiber flexibilizing agent system and do not significantly and adversely affect the softness or strength character of the present invention. The following materials are expressly included, but their inclusion is not offered to be all-inclusive.

Retention aids can be useful for retaining fine particulate materials which are applied via the wet end of papermaking. A number of materials are marketed as so-called "retention aids", a term as used herein, referring to additives used to increase the retention of the fine furnish solids in the web during the papermaking process. Without adequate retention of the fine solids, they are either lost to the process effluent or accumulate to excessively high concentrations in the recirculating white water loop and cause production difficulties including deposit build-up and impaired drainage. Chapter 17 entitled "Retention Chemistry" of "Pulp and Paper, Chemistry and Chemical Technology", 3rd ed. Vol. 3, by J. E. Unbehend and K. W. Britt, A Wiley Interscience Publication, incorporated herein by reference, provides the essential understanding of the types and mechanisms by which polymeric retention aids function. A flocculant agglomerates suspended particles generally by a bridging mechanism. While certain multivalent cations are considered common flocculants, they are generally being replaced in practice by superior acting polymers which carry many charge sites along the polymer chain.

It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. Charge biasing can be done by the use of relatively low molecular weight cationic synthetic polymers, specifically those having a molecular weight of no higher than about 500,000 and more specifically no higher than about 200,000, or even no higher than about 100,000. The charge densities of such low molecular weight cationic synthetic polymers are relatively high. These charge densities range from about 4 to about 8 equivalents of cationic nitrogen per kilogram of polymer. An exemplary material is Alcofix 159®, a product of Ciba Geigy, Inc. headquarted in Basel, Switzerland. The use of such materials is expressly included in the scope of the present invention.

The use of high surface area, high anionic charge microparticles for the purposes of improving formation, drainage, strength, and retention is taught in the art. The disclosure of U.S. Pat. No. 5,221,435 is incorporated herein by reference. Common materials for this purpose include, without limitation, silica colloid, or bentonite clay.

If some measure of permanent wet strength is desired, the group of chemicals: including polyamide-epichlorohydrin, polyacrylamides, styrene-butadiene lattices; insolubilized polyvinyl alcohol; urea-formaldehyde; polyethyleneimine; chitosan polymers and mixtures thereof can be added to the papermaking furnish or to the embryonic web. Such resins include, without limitation, cationic wet strength resins, such as polyamide-epichlorohydrin resins. Suitable types of such resins are described in U.S. Pat. Nos. 3,700,623 and 3,772,076, the disclosure of both being hereby incorporated by reference. One commercial source of useful polyamide-epichlorohydrin resins is Hercules, Inc. of Wilmington, Del., which markets such resin under the mark Kymene 557H®.

Some fibrous structures benefit from so-called temporary wet strength. This is especially useful if such products are to be disposed in the sewer and septic systems. One method of delivering temporary wet strength is to provide for the formation of acid-catalyzed hemiacetal formation through the introduction of ketone or, more specifically aldehyde functional groups on the papermaking fibers or in a binder additive for the papermaking fibers. One binder material that have been found particularly useful for imparting this form of fugitive wet strength is Parez 750 offered by Cytec of Stamford, Conn.

Other additives can also be used to augment this wet strength mechanism. This technique for delivering temporary wet strength is well known in the art. Exemplary art, incorporated herein by reference for the purpose of showing methods of delivering the fugitive wet strength to the web, includes the following U.S. Pat. Nos. 5,690,790; 5,656,746; 5,723,022; 4,981,557; 5,008,344; 5,085,736; 5,760,212; 4,605,702; 6,228,126; 4,079,043; 4,035,229; 4,079,044; and 6,127,593.

While the hemiacetal formation mechanism is one suitable technique for generating temporary wet strength, there are other methods, such as providing the sheet with a binder mechanism which is more active in the dry or slightly wet condition than in the condition of high dilution as would be experienced in the toilet bowl or in the subsequent sewer and septic system. Such methods have been primarily directed at web products which are to be delivered in a slightly moist or wet condition, then will be disposed under situation of high dilution. The following references are incorporated herein by reference for the purpose of showing exemplary systems to accomplish this, and those skilled in the art will readily recognize that they can be applied to the webs of the present invention which will be supplied generally at lower moisture content than those described therewithin: U.S. Pat. Nos. 4,537,807; 4,419,403; 4,309,469; and 4,362,781.

If enhanced absorbency is needed, surfactants may be used to treat the tissue paper webs of the present invention. The level of surfactant content, if used, can be from about 0.01% to about 2.0% by weight, based on the dry fiber weight of the tissue web. The surfactants can beneficially have alkyl chains with eight or more carbon atoms. Exemplary anionic surfactants include linear alkyl sulfonates and alkylbenzene sulfonates. Exemplary nonionic surfactants include alkylglycosides including alkylglycoside esters such as Crodesta SL-40® which is available from Croda, Inc. (New York, N.Y.); alkylglycoside ethers as described in U.S. Pat. No. 4,011,389, issued to Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.). Alternatively, cationic softener active ingredients with a high degree of unsaturated (mono and/or poly) and/or branched chain alkyl groups can greatly enhance absorbency.

The present invention also expressly includes variations in which chemical softening compositions and/or agents can be added as a part of the papermaking process as part of the furnish preparation or subsequent to web formation. Such chemical softening compositions may also comprise a fiber flexibilizing agent. Chemical softening compositions and/or agents may be included by wet end addition. Suitable chemical softening compositions and/or agents comprise quaternary ammonium compounds including, but not limited to, the well-known dialkyldimethylammonium salts (e.g., ditallowdimethylammonium chloride, ditallowdimethylammonium methyl sulfate, di(hydrogenated tallow) dimethyl ammonium chloride, etc.). Particularly suitable variants of these softening compositions include mono or diester variations of the before mentioned dialkyldimethylammonium salts and ester quaternaries made from the reaction of fatty acid and either methyl diethanol amine and/or triethanol amine, followed by quaternization with methyl chloride or dimethyl sulfate. Another class of papermaking-added chemical softening compositions comprises the well-known organo-reactive polydimethyl siloxane ingredients, including amino functional polydimethyl siloxane. These may be wet end-added or surface-applied. Other applicable art in the field of surface-applied chemical softeners incorporated herein by reference includes U.S. Pat. Nos. 6,179,961; 5,814,188; 6,162,329, and the application WO0022231A1 in the names of Vinson et. al. Filler materials may also be incorporated into the tissue of the present invention. U.S. Pat. No. 5,611,890, incorporated herein by reference, discloses filled tissue paper products that are acceptable as substrates for the present invention.

The above description of optional fiber flexibilizing agents is intended to be merely exemplary in nature, and is not meant to limit the scope of the invention.

According to the present invention, the fiber flexibilizing agent system can be applied to a paper web while it is in a dry condition. The term "dry condition" refers to the state, and "dry paper web" refers to the web itself, both defined herein as having a low moisture content of less than about 20%, and more specifically less than about 10%, and even more specifically less than about 3%. Therefore "dry tissue web" as used herein includes both webs which are dried to a moisture content less than the equilibrium moisture content thereof (so-called "overdried webs") and webs which have a low level of moisture remaining, specifically up as much as about 20% moisture.

Figure 4:
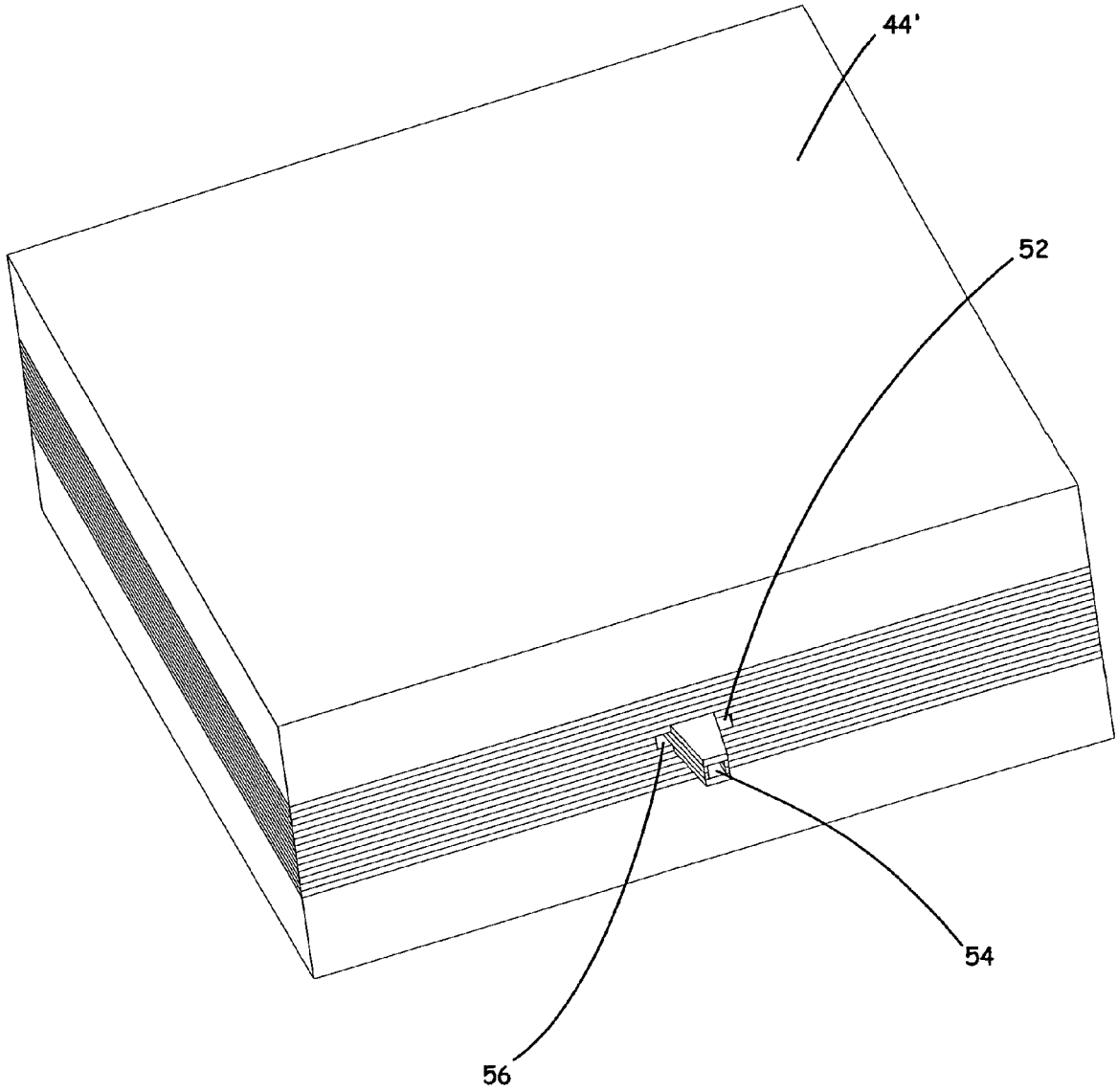
FIG. 4 is a schematic representation of a nozzle suitable for use in a non-contact applicator method embodiment of the present invention.

In one embodiment, the fiber flexibilizing agent system of the current invention may be applied after the tissue web has been dried and creped, and, more specifically, while the web is still at an elevated temperature, FIG. 4, reference numeral 50. The softening composition can be applied to the dried and creped web before the web is wound onto the parent roll. Thus, the softening composition can be applied to a hot, overdried web after the web has been creped and after the web has passed through the calender rolls (not shown) which control the caliper. The composition can be applied to either side or both sides of the tissue.

The fiber flexibilizing agent system can be beneficially applied to the web in a uniform fashion so that substantially the entire web surface benefits from the effect of the composition. Following application to the hot web, a minimal portion of the volatile components of the composition evaporates. Since the composition comprises maximum content of non-volatile agents, any water present in the composition becomes part of the new equilibrium moisture content of the tissue treated with the composition.

One method of macroscopically uniformly applying the softening composition to the web is spraying. Spraying has been found to be economical, and can be accurately controlled with respect to quantity and distribution of the composition. The dispersed composition can be applied onto the dried, creped tissue web before the web is wound into the parent roll. Those skilled in the art will recognize that spraying should be controlled to achieve a maximum possible distribution, i.e. small droplet size, limited by transfer efficiency. One acceptable spraying system uses ITW Dynatec UFD nozzles, offered by Illinois Tool Works of Glenview, Ill. One suitable nozzle model has five fluid orifices, each 0.46 mm×0.51 mm in size. The center of the 5 fluid orifices is oriented directly vertical to the path of the tissue paper web, while the outer orifices are angled at 15 degrees relative to vertical, and the two intermediate nozzles are angled at 7.5 degrees relative to vertical. Each fluid orifice has an associated air orifice situated on either side of it, for a total of 10 air orifices, each of 0.51 mm×0.51 mm size. The fluid orifice extends 0.5 cm beyond the lower surface of the nozzle. Nozzles are spaced about 5 cm apart and about 5 cm above the tissue paper web while it is being treated. Air pressure sufficient to create a uniformly atomized spray is used.

The following Example illustrates preparation of tissue paper according to the present invention. This example demonstrates the production of layered tissue paper webs comprising the fiber flexibilizing agent system according to the present invention. The composition is applied to one side of the web and the webs are combined into a two-ply bath tissue product. A pilot-scale Fourdrinier papermaking machine is used for the production of the tissue.

An aqueous slurry of NSK of about 3% consistency is made up using a conventional repulper and is passed through a stock pipe toward the headbox of the Fourdrinier.

In order to impart temporary wet strength to the finished product, a 1% dispersion of Parez 750® is prepared and is added to the NSK stock pipe at a rate sufficient to deliver 0.3% Parez 750® based on the dry weight of the NSK fibers. The absorption of the temporary wet strength resin is enhanced by passing the treated slurry through an in-line mixer.

An aqueous slurry of eucalyptus fibers of about 3% by weight is made up using a conventional repulper. In order to impart a temporary wet strength to the finished product and to reduce the dustiness or Tinting of the surface of the tissue paper, a 1% dispersion of Parez 750® is prepared and is added to the eucalyptus stock pipe at a rate sufficient to deliver 0.375% Parez 750® based on the dry weight of the eucalyptus fibers. The absorption of the temporary wet strength resin is enhanced by passing the treated slurry through an in-line mixer.

The NSK fibers are diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are both directed to a layered headbox capable of maintaining the slurries as separate streams until they are deposited onto a forming fabric on the Fourdrinier.

The paper machine has a layered headbox having a top chamber, a center chamber, and a bottom chamber. The eucalyptus fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 70% is made up of the eucalyptus fibers and 30% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively.

The embryonic wet web is transferred from the Fourdrinier wire, at a fiber consistency of about 15% at the point of transfer, to a patterned drying fabric. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filaments per inch, dual layer mesh. The thickness of the resin cast is about 10 mil above the supporting fabric. The knuckle area is about 40% and the open cells remain at a frequency of about 90 per square inch.

Further de-watering is accomplished by vacuum assisted drainage until the web has a 25 fiber consistency of about 30%.

While remaining in contact with the patterned forming fabric, the patterned web is pre-dried by air blow-through pre-dryers to a fiber consistency of about 65% by weight. The semi-dry web is then transferred to the Yankee dryer and adhered to the surface of the Yankee dryer with a sprayed creping adhesive comprising a 0.125% aqueous solution of polyvinyl alcohol. The creping adhesive is delivered to the Yankee surface at a rate of 0.1% adhesive solids based on the dry weight of the web. The fiber consistency is increased to about 98% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm (feet per minute) (about 244 meters per minute). The paper is wound in a roll using a surface driven reel drum having a surface speed of about 656 feet per minute.

In a free span between the doctor blade and the reel in a position at which the web is essentially horizontal, an applicator comprising spaced apart ITW Dynatec UFD nozzles, made by Illinois Tool Works of Glenview, Ill., are positioned at a point terminating about 5 cm above the web. Each of the nozzles has five fluid orifices, 0.46 mm×0.51 mm in size. The center of the five fluid orifices is oriented directly vertical to the path of the tissue paper web, while the outer orifices are angled at 15 degrees relative to vertical, and the two intermediate nozzles are angled at 7.5 degrees relative to vertical. Each fluid orifice has an associated air orifice situated on either side of it, for a total of ten air orifices, each 0.51 mm×0.51 mm in size. The fluid orifice extends 0.5 cm beyond the lower surface of the nozzle. Nozzles are spaced about 5 cm apart and about 5 cm above the tissue web while it is being treated. Fluid is directed at the web in order to deliver about 15% by weight of the fiber flexibilizing agent system. About 15 psi of air pressure is sufficient to create a uniformly atomized spray.

The fiber flexibilizing agent system comprises material listed in the following TABLE:

| Trade Name | Chemical Name | % By WT | Supplier |
|---|---|---|---|
| Water | Water | 24.5% | |
| Carbowax 200 | Polyethylene Glycol 200 | 52.7% | Dow Chemical Midland, MI |
| Argo ® | Corn Starch, Unmodified | 22.8% | ACH Food Companies, Memphis, TN |

The paper is subsequently converted into a single-ply toilet tissue having a basis weight of about 34 g/m$^2$. It has about 15.8 g/cm of wet tensile strength. It has about 15% of the fiber flexibilizing agent system and is a soft, low linting toilet tissue product.

Application Methods

The present invention provides methods for treating a fibrous structure in need of treatment. The method comprises contacting the fibrous structure with a fiber flexibilizing agent system comprising a fiber flexibilizing agent.

FIG. 1 schematically represents a fibrous structure making method 10 that is suitable for applying a fiber flexibilizing agent system comprising a fiber flexibilizing agent (not shown) by an application method in accordance with the present invention 12 to a fibrous structure 14. The fibrous structure 14 can be formed by any suitable fibrous structure forming process known in the art, including but not limited to conventional papermaking processes and/or through-air dried papermaking processes. The fibrous structure 14 is carried via a carrier fabric 16 to a cylindrical dryer 18, such as a Yankee dryer, at which point the fibrous structure 14 can be transferred to the cylindrical dryer 18. A pressure roll 20 may be used to aid the transfer to the cylindrical dryer 18 while the transfer fabric 16 travels past a turning roll 22. In one embodiment, the surface 24 of the cylindrical dryer 18 may have an adhesive 26 applied to it via an adhesive source, such as a spray applicator 28. The cylindrical dryer 18 may be heated, such as steam-heated, to facilitate drying of the fibrous structure 14 as the fibrous structure 14 is in direct and/or indirect contact with the surface 24 of the cylindrical dryer 18. Heated air may also be applied to the fibrous structure 14 via a heated air source, such as a drying hood 30. The fibrous structure 14 may then be transferred from the cylindrical dryer 18. A creping operation utilizing a creping blade 32 may be used to remove the fibrous structure 14 from the cylindrical dryer 18. Once the fibrous structure 14 has been removed from the cylindrical dryer 18, the fibrous structure 14 is then treated with a fiber flexibilizing agent (not shown) via the application method 12. One or both sides of the fibrous structure 14 may be treated with the fiber flexibilizing agent. Once the fibrous structure 14 has been treated with the fiber flexibilizing agent via the application method 12, the treated fibrous structure 14' can then be wound onto a parent roll 34 by any suitable method known to those of ordinary skill in the art, such as via a reel 36.

Preferably, the fiber flexibilizing agent system is applied to a dry fibrous structure. The term "dry fibrous structure" as used herein includes both fibrous structures which are dried to a moisture content of less than the equilibrium moisture content thereof (overdried-see below) and fibrous structures which are at a moisture content in equilibrium with atmospheric moisture. A semi-dry fibrous structure includes a fibrous structure with a moisture content exceeding its equilibrium moisture content.

As used herein, the term "hot fibrous structure" refers to a fibrous structure, which is at an elevated temperature relative to room temperature. Preferably the elevated temperature of the fibrous structure is at least about 43° C., and more preferably at least about 65° C.

The moisture content of a fibrous structure is related to the temperature of the fibrous structure and the relative humidity of the environment in which the fibrous structure is placed. As used herein, the term "overdried fibrous structure" refers to a fibrous structure that is dried to a moisture content less than its equilibrium moisture content at standard test conditions of 23° C. and 50% relative humidity. The equilibrium moisture content of a fibrous structure placed in standard testing conditions of 23° C. and 50% relative humidity is approximately 7%. A fibrous structure of the present invention can be overdried by raising it to an elevated temperature through use of drying means known to the art such as a Yankee dryer or through air drying. Preferably, an overdried fibrous structure will have a moisture content of less than 7%, more preferably from about 0 to about 6%, and most preferably, a moisture content of from about 0 to about 3%, by weight.

Fibrous structure exposed to the normal environment typically has an equilibrium moisture content in the range of 5 to 8%. When a fibrous structure is dried and creped the moisture content in the fibrous structure is generally less than 3%. After manufacturing, the fibrous structure absorbs water from the atmosphere. In a preferred process of the present invention, advantage is taken of the low moisture content in the fibrous structure as it leaves the doctor blade as it is removed from the Yankee dryer (or the low moisture content of similar fibrous structures as such fibrous structures are removed from alternate drying means if the process does not involve a Yankee dryer).

In one embodiment, the fiber flexibilizing agent system of the present invention is applied to an overdried fibrous structure shortly after it is separated from a drying means and before it is wound onto a parent roll.

Alternatively, the fiber flexibilizing agent system of the present invention may be applied to a semi-dry fibrous structure, for example while the fibrous structure is on the Fourdrinier cloth, on a drying felt or fabric, or while the fibrous structure is in contact with the Yankee dryer or other alternative drying, means.

Finally, the fiber flexibilizing agent system can also be applied to a dry fibrous structure in moisture equilibrium with its environment as the fibrous structure is unwound from a parent roll as for example during an off-line converting operation.

In another embodiment, the fiber flexibilizing agent system of the present invention may be applied after the fibrous structure has been dried and creped, and, more preferably, while the fibrous structure is still at an elevated temperature. Preferably, the fiber flexibilizing agent system is applied to the dried and creped fibrous structure before the fibrous structure is wound onto the parent roll.

The fiber flexibilizing agent via the fiber flexibilizing agent system can be added to either side of the fibrous structure singularly, or to both sides; preferably, the fiber flexibilizing agent is applied to only one side of the fibrous structure; the side of the fibrous structure with raised regions, which will later be orientated toward the exterior surface of the sanitary tissue paper product.

The fibrous structure of the present invention may be moving at a speed of greater than about 100 m/min and/or greater than about 300 m/min and/or greater than about 500 m/min when the fiber flexibilizing agent system is applied thereto.

Alternatively, effective amounts of fiber flexibilizing agent via the fiber flexibilizing agent systems of the present invention may also be applied to a fibrous structure that has cooled after initial drying and has come into moisture equilibrium with its environment. The method of applying the fiber flexibilizing agent systems of the present invention is substantially the same as that described above for application of such compositions to a hot and/or overdried fibrous structure.

1) Transfer Surface Application (i.e., by Means of Calender Rolls and/or Turning Rolls and/or Spreading Rolls and/or Yankee Dryers)

Figure 2:
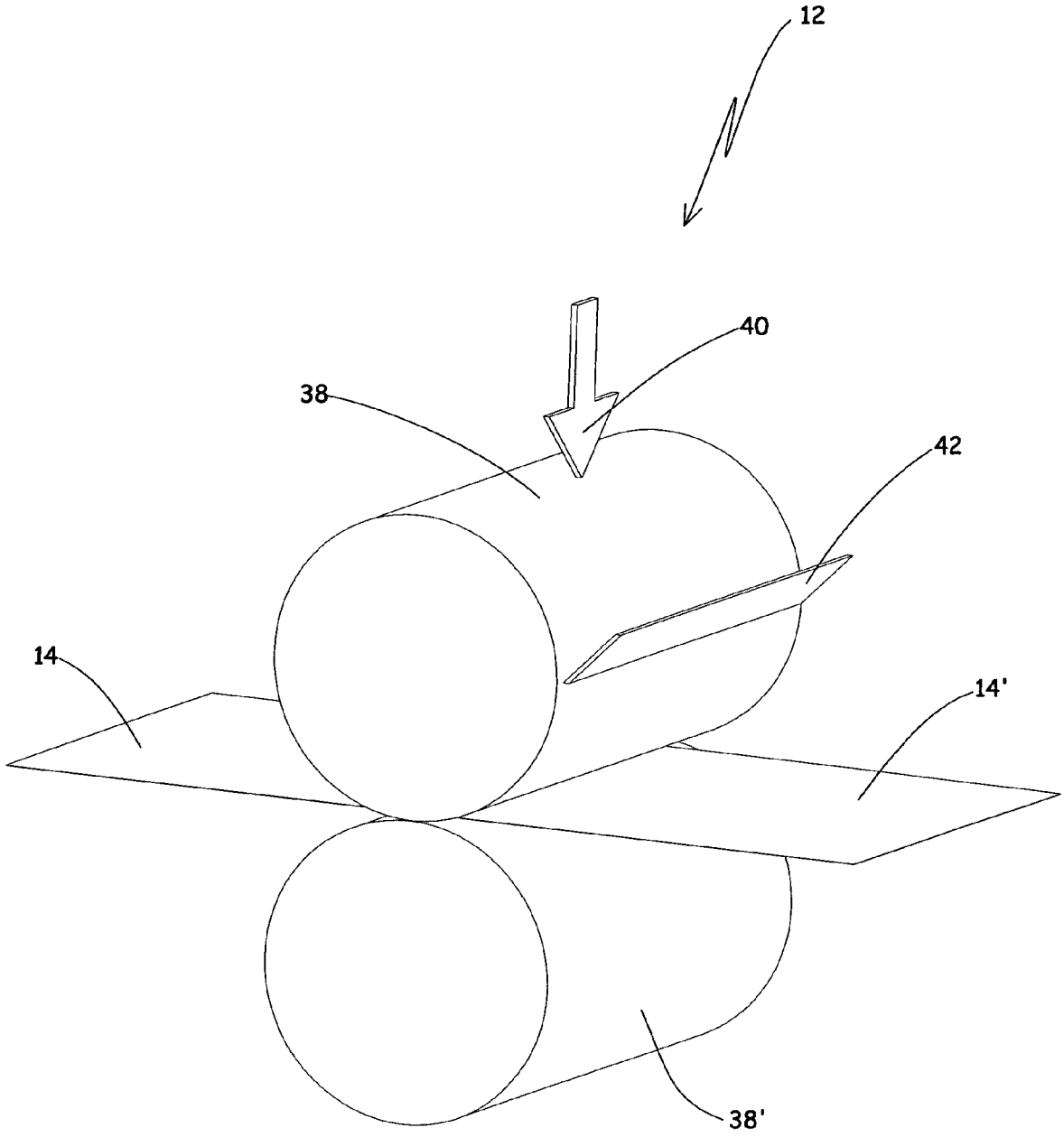
FIG. 2 is a schematic representation of a transfer surface method embodiment of the present invention.

As represented in FIG. 2, the application method 12 of FIG. 1 may comprise applying the fiber flexibilizing agent system comprising a fiber flexibilizing agent to a surface of a fibrous structure 14 using a transfer surface 38, such as a calender roll and/or a cylindrical dryer, turning rolls, or spreading rolls (not shown). "Spreader roll(s)" as used herein include rollers designed to apply cross direction stresses in order to smooth moving/traveling fibrous structures for example to remove wrinkles. Nonlimiting examples include bowed rollers commercially available from Stowe Woodward—Mount Hope Company of Westborough, Mass. "Turning roll(s)" as used herein refers to any predominantly straight roller engaging the moving/traveling fibrous structure. Turning rolls include idlers which may be externally driven or they may be driven by the moving/ traveling fibrous structure. Externally driven turning rolls are preferred since it is easier to maintain the relative speed difference of the roller surface compared to the fibrous structure as prescribed herein.

A fiber flexibilizing agent system comprising a fiber flexibilizing agent 40 is applied to the transfer surface 38 by any suitable means known in the art. When the a surface of a fibrous structure 14 contacts the transfer surface 38, the fiber flexibilizing agent system 40, especially the fiber flexibilizing agent, is transferred from the transfer surface 38 to the surface of the fibrous structure 14 thus producing a treated fibrous structure 14'. Another potential transfer surface, such as another calender roll, such as 38' may be needed depending upon the manner the fibrous structure 14 contacts the transfer roll 38. The additional transfer surface 38' may, but does not have contain the fiber flexibilizing agent system 40. The transfer surface 38 may comprise a doctor blade 42 such that excess fiber flexibilizing agent system 40 is removed from the transfer surface 38. Calender roll transfer surface 38 is moving at a different speed than the fibrous structure 14. For example, the calender roll may be moving, such as rotating, at a speed differential compared to the speed of the fibrous structure of at least about 0.3% and/or at least about 0.5% and/or at least about 0.7% and/or at least about 1%.

The transfer surface is normally maintained at a temperature near that of the fibrous structure which is contacting it. Therefore, it is typically at temperature of from about 15° C. (60° F.) to about 82° C. (180° F.).

Preferably, the fiber flexibilizing agent system is applied to the transfer surface in a macroscopically uniform fashion for subsequent transfer to the fibrous structure so that substantially the entire surface of the fibrous structure benefits from the effect of the fiber flexibilizing agent system. Following application to the transfer surface, at least a portion of the volatile components of any vehicle preferably evaporates leaving preferably a thin film containing any remaining unevaporated portion of the volatile components of the vehicle, the fiber flexibilizing agent, and other non-volatile components of the fiber flexibilizing agent system. By "thin film" it is meant any thin coating, haze or mist on the transfer surface. This thin film can be microscopically continuous or be comprised of discrete elements. If the thin film is comprised of discrete elements, the elements can be of uniform size or varying in size; further they may be arranged in a regular pattern or in an irregular pattern, but macroscopically the thin film is uniform. Preferably the thin film is composed of discrete elements.

Methods of macroscopically uniformly applying the fiber flexibilizing agent system to the transfer surface include spraying and printing. Spraying has been found to be economical, and can be accurately controlled with respect to quantity and distribution of the fiber flexibilizing agent system, so it is more preferred. Preferably, the dispersed fiber flexibilizing agent system is applied from the transfer surface onto the dried, creped fibrous structure after the Yankee dryer and before the parent roll. A particularly convenient means of accomplishing this application is to apply the fiber flexibilizing agent system to one or both of a pair of heated calender rolls which, in addition to serving as hot transfer surfaces for the present fiber flexibilizing agent system, also serve to reduce and control the thickness of the dried fibrous structure to the desired caliper of the finished product. Such convenient means are described in greater detail in U.S. Pat. No. 6,162,329.

In one embodiment, the transfer surface may be cleaned by any suitable cleaning method known in the art.

2) Non-Contact (i.e., Spray) Application

Figure 3:
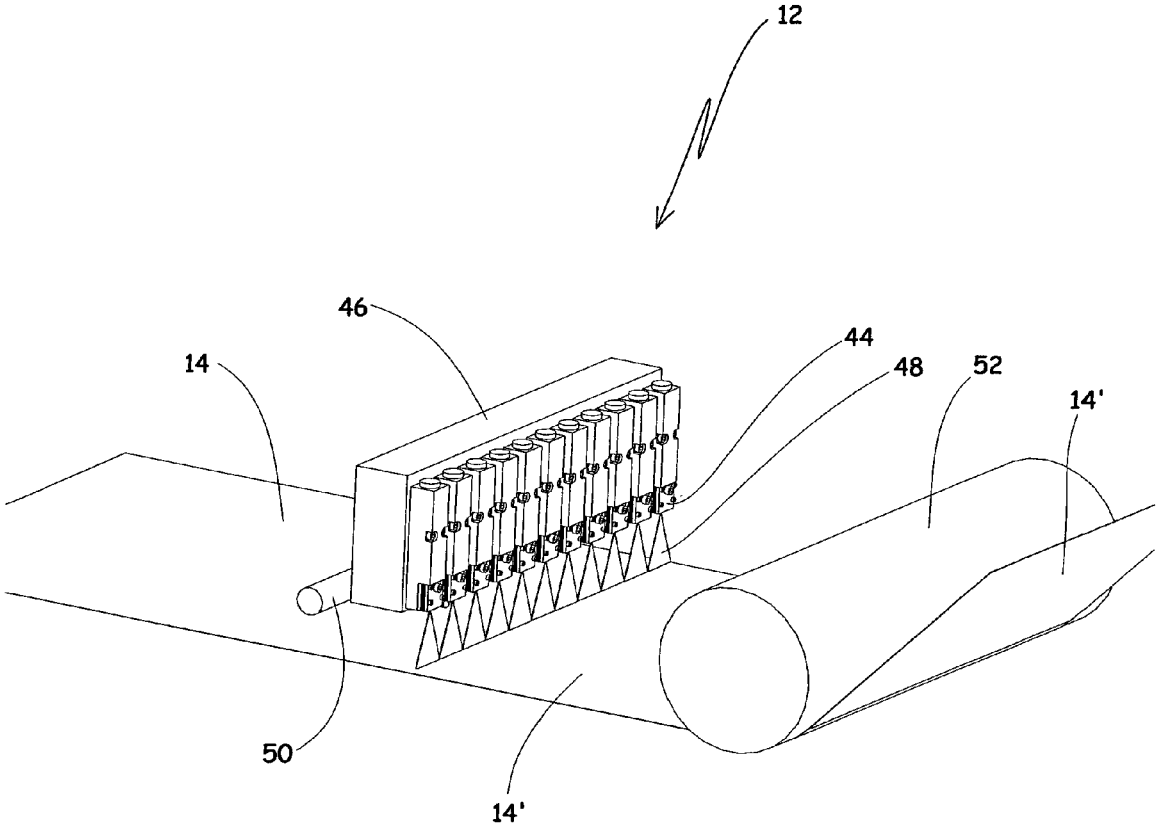
FIG. 3 is a schematic representation of a non-contact applicator method embodiment of the present invention.

As represented in FIG. 3, the application method 12 of FIG. 1 may comprise applying a fiber flexibilizing agent system comprising a fiber flexibilizing agent using a non-contact applicator, such as nozzles 44, to apply the fiber flexibilizing agent system onto the surface of the fibrous structure 14 to produce a treated fibrous structure 14'. In addition to a spray application, as illustrated in FIG. 3, the fiber flexibilizing agent system comprising a fiber flexibilizing agent may also be non-contact applied via a drip and/or curtain (not shown). In FIG. 3, an array of nozzles 44, preferably oscillatory nozzles, are mounted to a fiber flexibilizing agent distribution manifold 46. The fiber flexibilizing agent 48 is applied via at least one nozzle 44 to the surface of the fibrous structure 14 in the form of a spray, preferably an oscillatory spray.

A nozzle cleaning system 50 can be employed to keep the nozzles 44 free from debris, dust and/or residual fiber flexibilizing agent. Further, a post turning roll 52 may optionally be employed on the treated surface of fibrous structure 14' to direct particles, preferably fiber flexibilizing agent particles, that may not be in contact with the surface of the fibrous structure 14', into contact with the surface of the fibrous structure 14'. If optional post turning roll 52 is employed, it is preferably driven at a surface speed differential compared to fibrous structure 14'. Preferably, this surface speed differential greater than 0.1%, more preferably greater than 0.3, and most preferably greater than 0.5%.

FIG. 4 schematically represents one embodiment of an oscillatory nozzle 44' having a liquid exit orifice 54 and an air exit orifice 56. Oscillatory nozzle is a termed used herein to refer to a nozzle which promotes an oscillatory motion in the extrudate upon exit from the nozzle. Without being bound by theory, oscillatory flow motion is believed to be the result of alternating forces induced when the fluid flow is flanked on each side by atomizing air jets which are directed generally parallel to the fluid stream. Angle of air stream directed from each of the flanking air exit orifices 56 relative to liquid exit orifice 54 should therefore be limited to no more than about 20°, preferably less than about 10°. Deeper angles tend to prematurely obliterate the fluid jet resulting in creation of an aerosol fraction, which tends to migrate away from the application zone and promote the creation of kgnarr. A nonlimiting example of a suitable nozzle comprising a non-contact applicator is commercially available from Illinois Tool Works Dynatec as part no. 107921.

Figure 5:
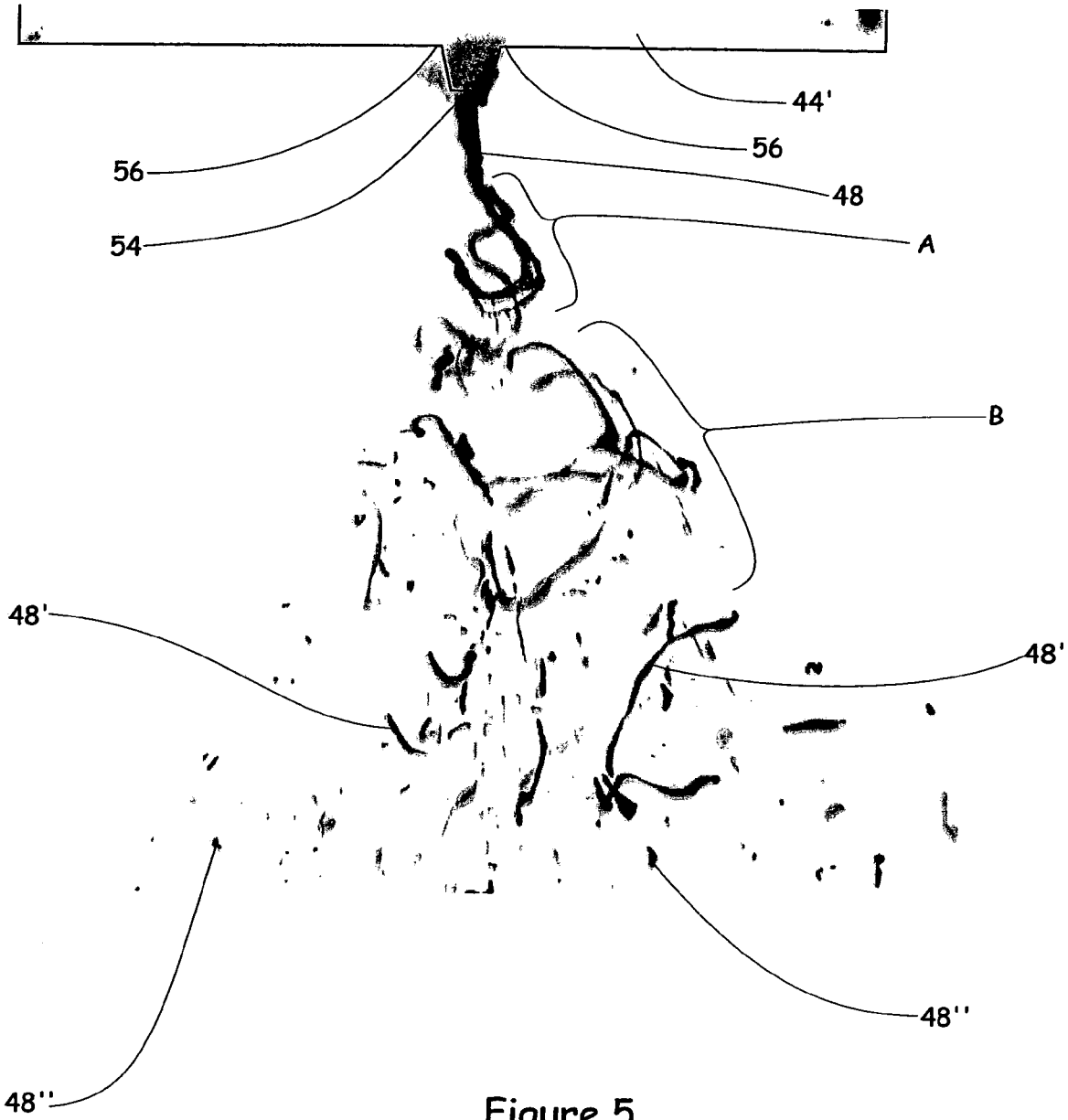
FIG. 5 is a schematic representation of a spray discharge that can be obtained from an oscillatory nozzle of the present invention.

FIG. 5 schematically illustrates one embodiment of a spray produced by an oscillatory nozzle 44'. The fiber flexibilizing agent 48 exits the liquid exit orifice 54 where it is stressed by an air stream that is exiting from the air exit orifice 56. As the fiber flexibilizing agent 48 moves away from the liquid exit orifice 54 it begins to oscillate, represented by zone A. As the amplitude of the oscillation increases, the fiber flexibilizing agent 48 elongates, as represented by zone B. As the fiber flexibilizing agent 48 elongates in zone B, the fiber flexibilizing agent breaks into sections of elongated fiber flexibilizing agent 48'. The elongated fiber flexibilizing agent 48' then begins to contract back to a droplet 48", preferably a spherical-shaped droplet.

Figure 6:
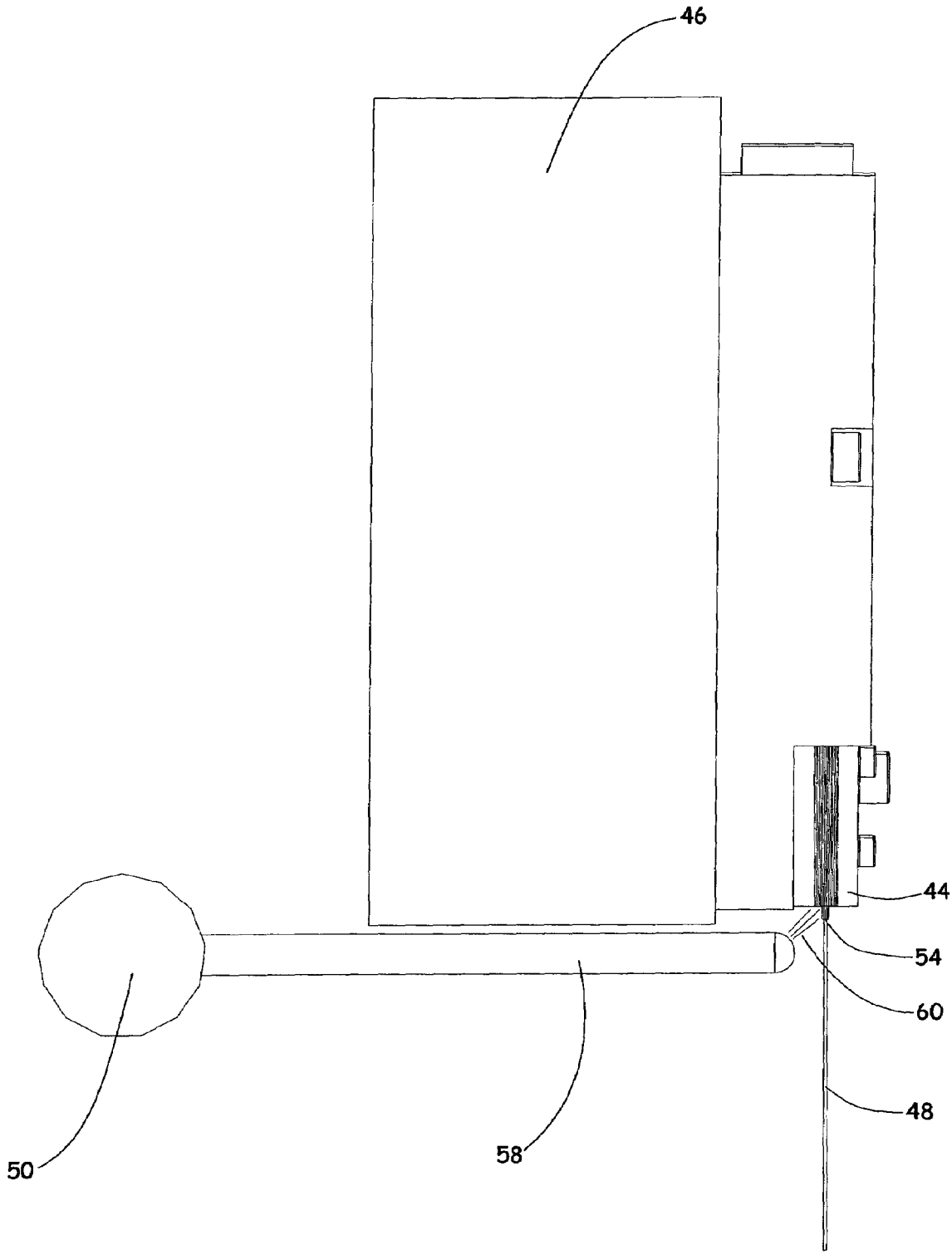
FIG. 6 is a schematic representation of a nozzle cleaning system that can be used with a nozzle of a non-contact applicator method embodiment of the present invention.

An embodiment of a nozzle cleaning system 50 for use with nozzles 44 is represented in FIG. 6. The nozzle cleaning system 50 comprises a traversing cleaning nozzle 58 that when in operation, directs air 60 towards the liquid exit orifice 54 and the air exit orifice 56 of a nozzle 44, preferably each nozzle 44, thus removing any accumulated debris from the exit orifices 54 and 56.

In one embodiment, nozzles 44 are positioned adjacent to the fibrous structure 14' at a separation distance of less than about 10 cm and/or less than about 5 cm and/or less than about 3 cm and/or less than about 1 cm and/or less than about 0.51 cm.

A nonlimiting example of a suitable non-contact applicator is commercially available from Illinois Tool Works.

3) Extrusion Application

Figure 7:
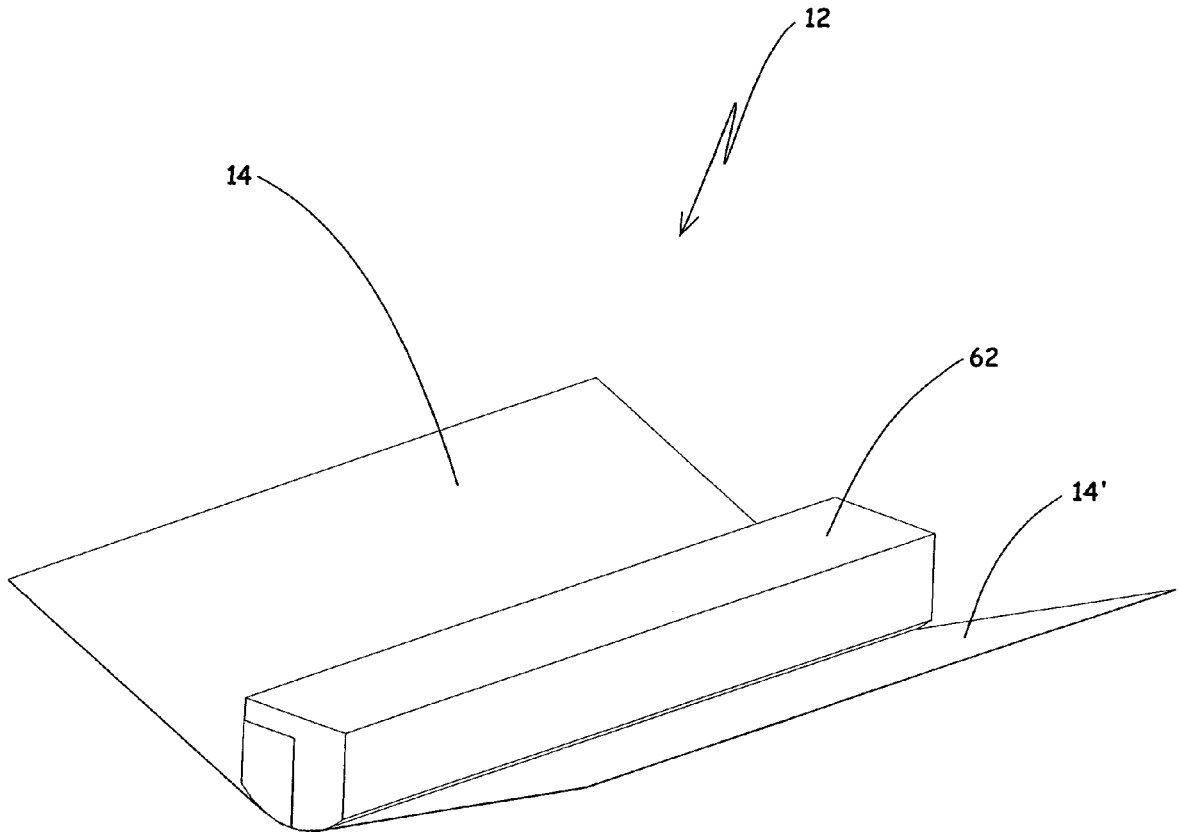
FIG. 7 is a schematic representation of an extrusion application embodiment of the present invention.

As represented in FIG. 7, the application method 12 of FIG. 1 may comprise applying the fiber flexibilizing agent 48 using an extrusion system, such as a slot extrusion die 62. The fiber flexibilizing agent 48 is extruded out of the slot extrusion die 62 onto the surface of the fibrous structure 14 to produce a treated fibrous structure 14'.

Figure 8:
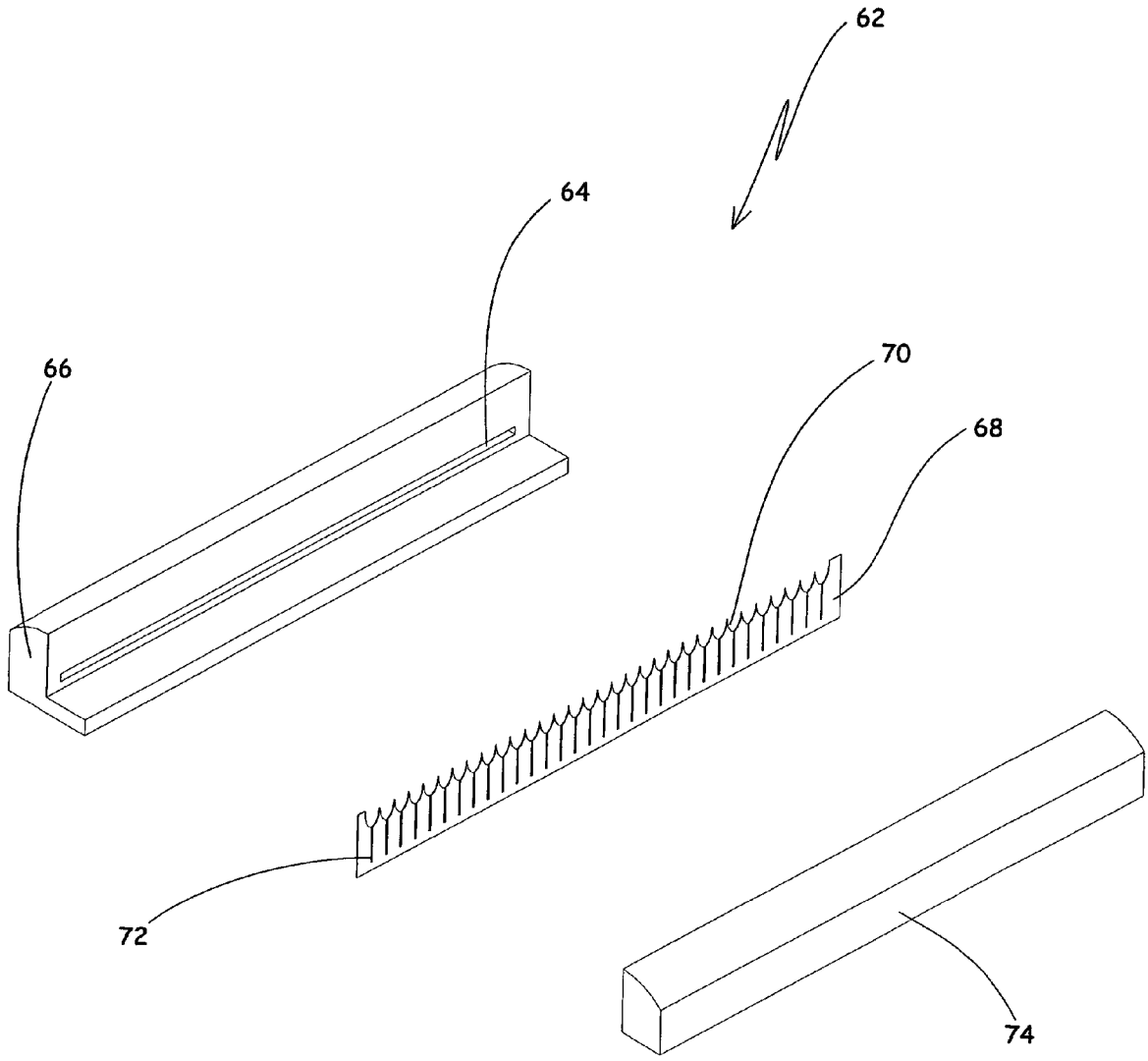
FIG. 8 is an exploded, schematic representation of a slot extrusion die suitable for use in an extrusion application method embodiment of the present invention.

FIG. 8 shows, in an exploded view, an embodiment of a slot extrusion die 62 suitable for use in accordance with the present invention. The fiber flexibilizing agent 48 flows into a fiber flexibilizing agent distribution chamber 64 of a slot extrusion distribution section 66 towards a shim 68. The fiber flexibilizing agent 48 is spread via capillary force at flared ends 70 (discharge surface) of a distribution channel 72 of the shim 68 wherein it then exits the slot extrusion die 62. Slot extrusion lip 74 ensures that the fiber flexibilizing agent 48 exits the slot extrusion die 62 via the flared ends 70 of the distribution channel 72 of the shim 68.

In one embodiment, the discharge surface of the applicator is in contact with the fibrous structure for a distance greater than about 10 cm and/or greater than about 15 cm and/or greater than about 20 cm.

In another embodiment, the discharge surface may be cleaned by any suitable cleaning method known in the art.

Total Dry Tensile Strength Method:

"Total Dry Tensile Strength" or "TDT" of a fibrous structure of the present invention and/or a paper product comprising such fibrous structure is measured as follows. One (1) inch by five (5) inch (2.5 cm×12.7 cm) strips of fibrous structure and/or paper product comprising such fibrous structure are provided. The strip is placed on an electronic tensile tester Model 1122 commercially available from Instron Corp., Canton, Massachusetts in a conditioned room at a temperature of 73° F.±4° F. (about 28° C.±2.2° C.) and a relative humidity of 50%±10%. The crosshead speed of the tensile tester is 2.0 inches per minute (about 5.1 cm/minute) and the gauge length is 4.0 inches (about 10.2 cm). The TDT is the arithmetic total of MD and CD tensile strengths of the strips.

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure and/or paper product comprising the fibrous structure.

Total Wet Tensile Strength Method:

An electronic tensile tester (Thwing-Albert EJA Materials Tester, Thwing-Albert Instrument Co., 10960 Dutton Rd., Philadelphia, Pa., 19154) is used and operated at a crosshead speed of 4.0 inch (about 10.16 cm) per minute and a gauge length of 1.0 inch (about 2.54 cm), using a strip of a fibrous structure of 1 inch wide and a length greater than 3 inches long. The two ends of the strip are placed in the upper jaws of the machine, and the center of the strip is placed around a stainless steel peg (0.5 cm in diameter). After verifying that the strip is bent evenly around the steel peg, the strip is soaked in distilled water at about 20° C. for a soak time of 5 seconds before initiating cross-head movement. The initial result of the test is an array of data in the form load (grams force) versus crosshead displacement (centimeters from starting point).

The sample is tested in both MD and CD orientations. The wet tensile strength of a fibrous structure is calculated as follows:

$$\text{Total Wet Tensile Strength} = \text{Peak Load}_{MD}(g_f)/2(\text{inch}_{width}) + \text{Peak Load}_{CD}(g_f)/2(\text{inch}_{width})$$

All documents cited in the Detailed Description of the Invention are, in relevant part, incorporated herein by reference; the citation of any document is not to be considered as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A single-ply or multi-ply sanitary tissue product comprising a fibrous structure comprising a surface comprising a fiber flexibilizing agent system comprising a fiber flexibilizing agent and an opacity increasing agent wherein the net change in opacity of the fibrous structure resulting from the fiber flexibilizing agent system is greater than the net change in opacity of the fibrous structure resulting from the individual components of the fiber flexibilizing agent system, wherein the fiber flexibilizing agent and the opacity increasing agent are present in the fiber flexibilizing agent system at a weight ratio of from about 2:1 to about 100:1.

2. The single-ply or multi-ply sanitary tissue product according to claim 1 wherein the fibrous structure further comprises a cellulosic fiber.

3. The single-ply or multi-ply sanitary tissue product according to claim 1 wherein the fiber flexibilizing agent is selected from the group consisting of humectants and plasticizers.

4. The single-ply or multi-ply sanitary tissue product according to claim 3 wherein the plasticizer comprises a polyhydroxy compound.

5. The single-ply or multi-ply sanitary tissue product according to claim 4 wherein the polyhydroxy compound comprises polyethylene glycol.

6. The single-ply or multi-ply sanitary tissue product according to claim 5 wherein the polyethylene glycol has a weight average molecular weight of from about 100 to about 500 g/mol.

7. The single-ply or multi-ply sanitary tissue product according to claim 1 wherein the opacity increasing agent is selected from the group consisting of: pigments, fillers and mixtures thereof.

8. The single-ply or multi-ply sanitary tissue product according to claim 1 wherein the opacity increasing agent is selected from the group consisting of: clay, calcium carbonate, titanium dioxide, talc, aluminum silicate, calcium silicate, alumina trihydrate, activated carbon, pearl starch, calcium sulfate, glass microspheres, diatomaceous earth, and mixtures thereof.

9. The single-ply or multi-ply sanitary tissue product according to claim 1 wherein the increase in opacity of the fibrous structure resulting from the fiber flexibilizing agent system is 0.05% points greater than the net increase in opacity of the fibrous structure resulting from individual components of the fiber flexibilizing agent system.

10. The single-ply or multi-ply sanitary tissue product according to claim 1 wherein the fiber flexibilizing agent is present in the fibrous structure at from about 2% to about 30% by weight of the fibrous structure.

11. The single-ply or multi-ply sanitary tissue product according to claim 1 wherein the opacity increasing agent is present in the fibrous structure at from about 0.02% to about 15% by weight of the fibrous structure.

12. A method for making a single-ply or multi-ply sanitary tissue product, the method comprising the steps of:

a) providing a single-ply or multi-ply sanitary tissue product comprising a fibrous structure comprising a surface;

b) contacting the surface of the fibrous structure with a fiber flexibilizing agent system comprising a fiber flexibilizing agent and an opacity increasing agent such that the net change in opacity of the fibrous structure resulting from the fiber flexibilizing system is greater than the net change in opacity of the fibrous structure resulting from the individual components of the fiber flexibilizing agent system, wherein the fiber flexibilizing agent and the opacity increasing agent are present in the fiber flexibilizing agent system at a weight ratio of from about 2:1 to about 100:1.

* * * * *

UNITED STATES PATENT AND TRADEMARK OFFICE

CERTIFICATE OF CORRECTION

PATENT NO. : 7,377,997 B2
APPLICATION NO. : 10/615970
DATED : May 27, 2008
INVENTOR(S) : Kenneth Douglas Vinson et al.

It is certified that error appears in the above-identified patent and that said Letters Patent is hereby corrected as shown below:

In Col. 13, line 22, the word "Tinting" should be linting.

Signed and Sealed this

Twenty-sixth Day of May, 2009

JOHN DOLL
*Acting Director of the United States Patent and Trademark Office*